US005587705A

United States Patent [19]

Morris

[11] Patent Number: 5,587,705

[45] Date of Patent: Dec. 24, 1996

[54] MULTIPLE ALERT SMOKE DETECTOR

[76] Inventor: Gary J. Morris, 2026 Glenmark Ave., Morgantown, W. Va. 26505

[21] Appl. No.: 297,403

[22] Filed: Aug. 29, 1994

[51] Int. Cl.[6] ..... G08B 17/10

[52] U.S. Cl. ..... 340/628; 340/326; 340/329; 340/531; 340/539

[58] Field of Search ..... 340/628, 629, 340/630, 504, 506, 517, 521, 539, 332, 815.4, 326, 329, 531, 539

[56] References Cited

U.S. PATENT DOCUMENTS

| | | | |
|---|---|---|---|
| 4,232,308 | 11/1980 | Lee et al. | 340/628 |
| 4,258,291 | 3/1981 | Scott et al. | 340/628 |
| 4,282,519 | 8/1981 | Haglund et al. | 340/628 |
| 4,363,031 | 12/1982 | Reinowitz | 340/628 |
| 4,401,978 | 8/1983 | Solomon | 340/628 |
| 4,462,022 | 7/1984 | Stolarcyzk | 340/506 |
| 4,570,155 | 2/1986 | Skarman et al. | 340/531 |
| 5,028,911 | 7/1991 | Wanat et al. | 340/628 |
| 5,159,315 | 10/1992 | Schultz et al. | 340/539 |

*Primary Examiner*—Jeffery Hofsass
*Assistant Examiner*—Ashok Mannava
*Attorney, Agent, or Firm*—Spencer D. Conard

[57] ABSTRACT

The battery powered smoke detector of the present invention is designed to provide an early warning of the presence of an environmental condition of fire or smoke to persons in remote areas of a building with respect to the location of the environmental condition. The smoke detector sensing the environmental condition emits an audible alarm of continuous tone, while emitting a frequency modulated radio signal directly to other like smoke detectors to activate their alarms in a manner indicative of the location of the smoke detector sensing the environmental alarm condition. Rechargeable light modules separate from the smoke detector are included that receive the frequency modulated radio signal from the smoke detector sensing the environmental alarm condition and illuminate paths of egress for the duration of the alarm condition or in case of 120VAC power failure. All components of the system are easy to install due to the modular design and conventional power sources. An intermittent activation of the frequency modulated receiving circuitry in the smoke detector unit conserves battery energy.

6 Claims, 2 Drawing Sheets

MULTIPLE ALERT SMOKE DETECTOR

BACKGROUND FOR THE INVENTION

Fire and the resulting smoke may unknowingly exist for significant periods of time in areas of buildings before the occupants are warned through conventional smoke detector systems. Even with a plurality of conventional smoke detectors, occupants in remote locations of a burning building may not be able to audibly detect the local alarm horn. A need, therefore, exists for smoke detection systems that can effectively provide early warning to building occupants in remote locations or levels away from the source of the smoke/fire and can provide a means for lighted paths of egress while doing so in a cost effective and simple manner. Such systems should be easy to install and operate to encourage useage. Smoke detectors designed for remote sensing are commonly electrically hardwired to a central annunciator/controller panel to indicate the location of the smoke within a building. Unfortunately, only some businesses and few residences are currently equipped with hardwired smoke detection systems with centralized smoke/fire annunciator panels. The wireless smoke detection system invented by Martin and Miller (U.S. Pat. No. 4,160,246) maintains a plurality of remote smoke sensors through a centralized receiver/annunciator panel. The communication system with environmental condition detection capability invented by Shultz and Malaspina (U.S. Pat. No. 5,159,315) affords a plurality of remote wireless environmental condition detectors all exchanging information through a centralized control panel and communicating to mobile users of portable radio transceivers. Installing and retrofitting of remote sensing smoke detection systems within buildings and residences without centralized annunciator panels is greatly facilitated with the wireless smoke detector system described herein with frequency modulated radio intercommunication capabilities to audibly indicate the location of the smoke detector which sensed smoke in a remote location and to provide means for lighted paths of egress all without the need for a central control unit.

SUMMARY OF THE INVENTION

The Multiple Alert Smoke Detector System is a smoke detection system that works with other smoke detectors of its own design to signal occupants of a building or residence when smoke is detected in the area of any of the detectors in use and remotely controls light modules to illuminate paths of egress or other desired areas during the environmental condition. A minimum of two Multiple Alert Smoke Detectors is needed for the system to be effective in its intended manner, but any additional number of smoke detection units or light modules can be employed as needed for desired coverage. If the smoke is sensed by any one detector, it emits a constant alarm tone (or other discernible tone) indicating that the smoke is in close proximity to said detector while it simultaneously transmits a preset, coded frequency modulated radio signal to all other Multiple Alert Smoke Detectors within the building tuned to the same said frequency which results in the remote smoke detector units emitting a pulsed tone to indicate that smoke has been detected elsewhere in the building to serve as an early warning for the occupants. The said pulsed tone pattern is selectively indicative of the location of the smoke and this pattern can be selected by the user. For example, an intermittent single pulse tone may be used to indicate that a Multiple Alert Smoke Detector located on the first floor of a building sensed smoke while an intermittent dual pulse tone could be used to indicate that a Multiple Alert Smoke Detector on the second floor sensed smoke, etc. A more simplistic and non-selectable coded alarm scheme was employed by Haglund and Payne (U.S. Pat. No. 4282519) with a hard-wired, interconnected smoke alarm system. The Multiple Alert Smoke Detection system is composed of two or more autonomous detector units which directly communicate to other like smoke detectors through a frequency modulated radio link between units without the need for a centralized control unit, thus providing flexibility in location selection, reduced risk of total system failure without a single centralized control unit and ease of installation of said system. The Multiple Alert Smoke Detector system has the added feature of providing wireless communication to remote light modules to illuminate paths of egress or any other room or area desired by the system user for the duration of the environmental condition. The light modules are 120 VAC/rechargeable battery powered units designed to energize the lamp during 120 VAC power failure or upon receiving the properly coded frequency modulated radio signal from any of the smoke detector units sensing the environmental condition within radio signal receiving range. These light modules are plugged into standard wall mounted 120 VAC receptacles to provide illumination in close proximity to the floor (approximately 40 cm above the floor) where the smoke is likely to be less dense compared to the location of normal room lighting.

DETAILED DESCRIPTION OF THE PREFERRED EMBODIMENT

Figure 1:
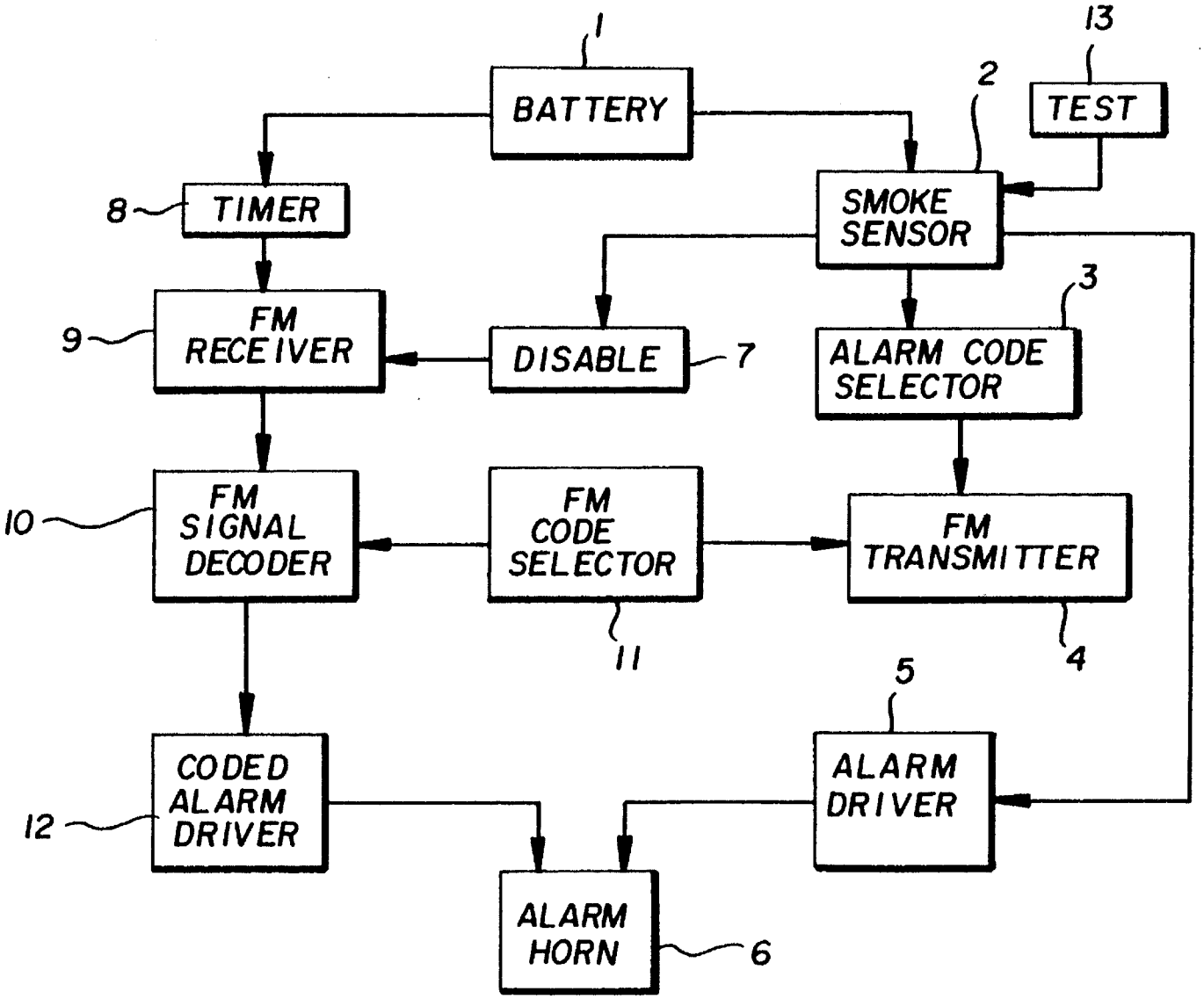
FIG. 1 is a block diagram of the Multiple Alert Smoke Detector according to the invention.

The Multiple Alert Smoke Detector diagram is shown in FIG. 1. The unit is powered by a long life 9 VDC battery (lithium or alkaline for example) 1. The smoke sensor 2 is an ionization smoke sensor or a photoelectric sensor typically employed in conventional smoke detector systems. Upon sensing smoke, the smoke sensor 2 signals the alarm driver circuit 5 to energize the alarm horn 6 to emit a constant audible tone to indicate that smoke has been sensed in proximity of the smoke sensor 2. Upon sensing smoke, the smoke sensor 2 signals the alarm code selector 3 which in turn signals the FM transmitter 4 to transmit a coded frequency modulated radio frequency signal defined by the FM code selector 11 to all other Multiple Alert Smoke Detectors and Light Modules (FIG. 2) within receiving range. The alarm code selector 3 is a user set switch that enables the user to define the pattern of audible code the alarm horn 6 of remote Multiple Alert Smoke Detectors emits upon receiving an FM signal from a Multiple Alert Smoke Detector that that initially senses the environmental condition. The alarm code selector 3 programs the FM transmitter of the Multiple Alert Smoke Detector to transmit said code. For example, Multiple Alert Smoke Detectors located on the first floor of a dwelling may be set by the alarm code selector 3 to transmit an FM radio signal to all other Multiple Alert Smoke Detectors instructing them to emit an intermittent, single audible pulse tone with periodicity, while Multiple Alert Smoke Detectors located on the second floor of a dwelling may be set by the alarm code selector 3 to transmit an FM signal to all other Multiple Alert Smoke Detectors instructing them to emit an intermittent, dual pulse tone with periodicity. Upon sensing smoke, the smoke sensor 2 also disables the FM receiver 9 within the local Multiple Alert Smoke Detector via a disable circuit 7. The FM code selector 11 is a user set switch that enables the user to select a coded FM radio signal to be used for both transmission and reception of the intercommunication link between the Multiple Alert Smoke Detectors. This code is user selectable to alleviate interference with spurious radio waves and with other Multiple Alert Smoke Detection systems that may be operating in close proximity and are not desired to be operated within the same system. The 9 VDC battery I is also used to power the electronic timer S and the FM receiver 9 that is intermittently activated in order to conserve battery power to receive coded FM radio frequency signals from other Multiple Alert Smoke Detectors tuned to the same coded FM frequency. The timer S is a low power timer (such as a CMOS) using electrical current on the order of nanoamperes that will intermittently activate the FM receiver 9 to receive coded FM signals emitted from other Multiple Alert Smoke Detectors in service in the area. One possible scenario to conserve battery power is to have the timer S activate the FM receiver 9 for a period of one second followed by a inactive period for the following 10 seconds. By this scenario, a maximum period of 10 seconds would elapse when a Multiple Alert Smoke Detector senses the environmental condition and the other Multiple Alert Smoke Detector alarms horns 6 activate. Upon reception of an FM radio frequency signal, the FM receiver 9 decodes the signal according to the FM code selector 11 setting. Upon verification that the said received FM signal originated from a Multiple Alert Smoke Detector, the FM signal decoder 10 then signals the coded alarm driver 12 which energizes the alarm horn in a coded audible manner according to the alarm code selector 3 setting of the Multiple Alert Smoke Detector sensing the environmental alarm condition. A user operable test switch 13 permits testing of the Multiple Alert Smoke Detector system by simulation of the smoke sensor 2 detecting an environmental condition.

Figure 2:
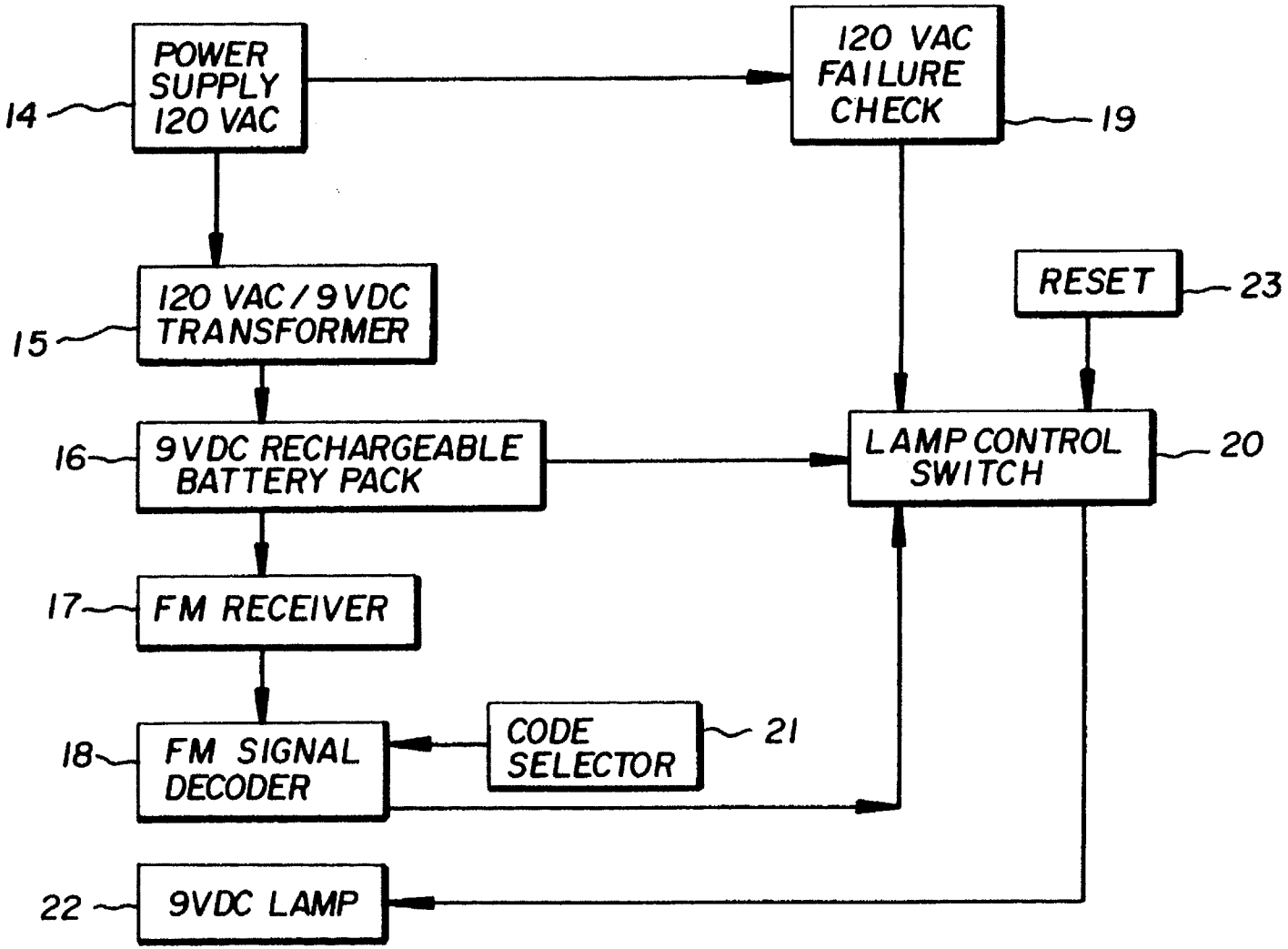
FIG. 2 is a block diagram of the light module to be used in conjunction with the preferred embodiment of the smoke detector diagram shown in FIG. 1.

The Multiple Alert Smoke Detector Light Module is shown in FIG. 2. The unit is powered by a 120 VAC standard electrical outlet 14 which powers a 120 VAC to 9 VDC electrical transformer 15. The transformer 15 maintains the 9 VDC rechargeable battery pack 16 in a state of full charge. The internal electrical switch 20 energizes the 9 VDC lamp 22 during a 120 VAC power failure as determined by the 120 VAC power check circuit 19 or by reception of a properly coded FM radio signal by the FM receiver 17 from a Multiple Alert Smoke Detector that sensed an environmental condition and transmitted said FM signal. The FM receiver 17 is continuously active and is powered by the 120 VAC to 9 VDC transformer 15 through the 9 VDC battery pack 16 when 120 VAC power 14 is available or by the 9 VDC battery pack 16 upon 120 VAC power 14 failure. The FM signal decoder 18 interprets the FM radio signals received by the FM receiver 17 as programmed by the user selectable code selector 21. The code selector is set to the same code as the FM code selector 11 in FIG. 1 if the light module is to be part of the same Multiple Alert Smoke Detector system. Upon reception of a valid FM signal from a Multiple Alert Smoke Detector sensing an environmental condition, the FM signal decoder 18 signals the internal switch 20 to energize the 9 VDC lamp 22. The 9 VDC lamp 22 is powered from the 120 VAC to 9 VDC transformer 15 as long as the 120 VAC power supply 14 is functioning, otherwise the 9 VDC lamp 22 is powered by the 9 VDC rechargeable battery pack 16. The wireless smoke detection system for indicating the environmental conditions of the presence of smoke may comprise: sensor means for indicating the presence of the environmental condition wherein the sensor is comprised of ionization or photodetector means; means for actuation of audible alarm for the duration of the environmental condition; means for wireless direct communication between smoke detector units utilizing user selectable, coded frequency modulated radio signal transmission wherein the smoke detector units are comprised, in part, of user selectable, coded frequency modulated radio transmitter and receiver, and optionally means are included for the use of long life battery power supply utilizing alkaline or lithium dry battery cells; wherein the communication signal is coded to indicate the location within the dwelling of the smoke detector sensing the environmental alarm condition by supplying means for use to manually select a coded audible alarm indicative of the environmental condition location to be emitted by all smoke detector units receiving the coded frequency modulated radio signal transmission from the smoke detector sensing the environmental condition; wherein means are included for conservation of battery cell energy through intermittent activation of the frequency modulated receiving circuitry wherein means are included for low power electronic circuitry to control the activation intermittency of the receiving circuitry; means are included for electronically simulating an environmental condition within the smoke detector wherein a test switch accessible to the user activates the local audible alarm and initiates a frequency modulated radio signal transmission to all other smoke detector units with an embedded code indicative of the location of the smoke detector under test by simulation of smoke detection to determine operability of components therein. The invention also involves a low voltage direct current, rechargeable light module to illuminate paths of egress from a dwelling during an environmental condition as detected through means claimed above comprising, means for direct connection to a 120 VAC power supply wall outlet or the like; means for conversion of 120 VAC power to a low voltage direct current power supply/battery charger; means for providing a source of illumination wherein said illumination source is comprised of a low voltage, minimum 7 watt incandescent lamp. The apparatus may include means by which to energize the low voltage lamp upon failure of 120 VAC power supply; or upon reception of a coded frequency modulated radio signal from a smoke detector frequency modulated transmission, wherein means are included for reception and decoding of the said frequency modulated radio signal wherein means are included for user to select the code for the radio decoding; the system may also include means for manually de-energizing the lamp wherein means are included for a reset switch accessible to the user. Once activated by reception of a Multiple Smoke Detector FM signal, the 9 VDC lamp 22 remains energized until no Multiple Alert Smoke Detectors tuned to the same coded FM frequency are sensing an environmental condition and a manual reset by occurs by a user operating the reset switch 23. When the 9 VDC lamp 22 is energized due to a 120 VAC supply 14 failure, said lamp remains energized until the 120 VAC power supply 14 is reactivated.

What is claimed:

1. A multiple alert smoke detection system comprising:

(a) a minimum of two multiple alert smoke detectors, each detector comprising sensor means for sensing the presence of smoke, each detector comprising an audible alarm;

(b) each detector comprising means for actuation of said audible alarm for the duration of the sensor means sensing of the smoke;

(c) each detector comprising means for wireless direct communication with other smoke detectors of said system, each detector comprising a transmitter for transmitting user selectable, coded frequency modulated radio signal transmission, each smoke detectors comprising user selectable, coded frequency modulated radio receiver each detector emitting an audible pattern defined by the radio signal received by the detector.

2. A multiple alert detection system comprising:

(a) at least two multiple alert smoke detectors, each detector comprising, (i) sensor means for sensing the presence of smoke, (ii) transmitter means for transmitting a frequency modulated radio signal, (iii) a frequency modulated code selector to define a coded frequency modulated radio signal to be transmitted by said transmitter means, (iv) receive means for radio signal reception, (v) an alarm code selector to define a pattern of an audible code transmitted in said radio signal, (vi) an audible alarm that emits said pattern of an audible code upon a receiver receiving said radio signal transmitted by said transmitter means.

3. The system of claim 2, wherein said system further comprises a low voltage direct current rechargeable light module to illuminate paths of egress from a dwelling during an environmental condition as detected by the system, said module comprising a lamp, means for direct connection of the module to an alternating current power supply wall outlet, a transformer for conversion of the alternating power to a direct current, a rechargeable battery for powering the module upon alternating current power failure, an internal electrical switch, and a frequency modulated receiver, said switch causing said lamp to be energized by upon receipt of a coded frequency modulated radio signal by the receiver.

4. A method for providing multiple alert smoke detection for a dwelling comprising:

(a) providing the multiple alert detection system in a dwelling having a first floor and a second floor, (b) locating a detector on the first floor of the dwelling, and (c) setting the alarm code selector of the first floor detector to cause the transmitter means of the first floor detector to transmit upon detection of smoke a frequency modulated radio signal defining an audible pattern to all other detectors in said system instructing all other detectors to emit said audible pattern defined by the radio signal.

5. The method of claim 4 wherein said method comprises (d) locating a detector on the second floor of the dwelling, and (e) setting the alarm code selector of the second floor detector to cause the second floor detector to transmit upon detection of smoke a frequency modulated radio signal to all other detectors in said system instructing said all other detectors to emit an intermittent, dual audible pulse tone with periodicity.

6. A dwelling having a first floor and a second floor, said dwelling comprising:

(a) a multiple alert detection system comprising, (i) sensor means for sensing the presence of smoke, (ii) transmitter means for transmitting a frequency modulated radio signal, (iii) a frequency modulated code selector to define a coded frequency modulated radio signal to be transmitted by said transmitter means, (iv) receive means for radio signal reception, (v) an alarm code selector to define a pattern of an audible code transmitted in said radio signal, (vi) an audible alarm that emits said pattern of an audible code upon a receiver receiving said radio signal transmitted by said transmitter means.

* * * * *